US012426683B2

(12) United States Patent
Campos, II et al.

(10) Patent No.: US 12,426,683 B2
(45) Date of Patent: Sep. 30, 2025

(54) SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Kristina Gerig, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/305,895

(22) Filed: Apr. 24, 2023

(65) Prior Publication Data

US 2023/0255313 A1 Aug. 17, 2023

Related U.S. Application Data

(63) Continuation of application No. 16/950,791, filed on Nov. 17, 2020, now Pat. No. 11,666,117.

(60) Provisional application No. 62/937,531, filed on Nov. 19, 2019.

(51) Int. Cl.

| | |
|---|---|
| ***A43B 13/20*** | (2006.01) |
| ***A43B 1/00*** | (2006.01) |
| ***A43B 13/18*** | (2006.01) |

(52) U.S. Cl.

CPC ..... *A43B 13/20* (2013.01); *A43B 1/0072* (2013.01); *A43B 13/186* (2013.01)

(58) Field of Classification Search

CPC ..... A43B 13/20; A43B 1/0072; A43B 13/186; A43B 13/189

See application file for complete search history.

(56) References Cited

U.S. PATENT DOCUMENTS

| | | | |
|---|---|---|---|
| 5,313,717 | A | 5/1994 | Allen et al. |
| D349,186 | S | 8/1994 | Passke |
| D351,056 | S | 10/1994 | Auger |
| 5,353,459 | A | 10/1994 | Potter et al. |

(Continued)

FOREIGN PATENT DOCUMENTS

| | | | |
|---|---|---|---|
| GB | 2435396 | A | 8/2007 |
| TW | 490293 | B | 6/2002 |
| WO | WO-2019118540 | A1 | 6/2019 |

OTHER PUBLICATIONS

Taiwan Patent Office, Office Action for Application No. 109140610 mailed Nov. 5, 2021.

(Continued)

*Primary Examiner* — Haley A Smith

(74) *Attorney, Agent, or Firm* — Honigman LLP; Matthew H. Szalach; Jonathan P. O'Brien

(57) ABSTRACT

A bladder for an article of footwear includes a first chamber having a first segment extending along a first side of the bladder and a second segment formed on an opposite side of the bladder from the first segment. The bladder further includes a second chamber at least partially surrounded by the first chamber and disposed between the first segment and the second segment. A manifold is in direct fluid communication with each of the first segment of the first chamber, the second segment of the first chamber, and the second chamber. A web area connects each of the first chamber, the second chamber, and the manifold. The bladder may include a first series of ports formed in the first segment of the first chamber and a second series of ports formed in the second segment of the first chamber.

19 Claims, 9 Drawing Sheets

(56) References Cited

U.S. PATENT DOCUMENTS

| | | | | |
|---|---|---|---|---|
| D377,111 | S | 1/1997 | Passke et al. | |
| D377,112 | S | 1/1997 | Passke et al. | |
| D386,894 | S | 12/1997 | Passke et al. | |
| 5,704,137 | A | 1/1998 | Dean et al. | |
| D391,750 | S | 3/1998 | Santos et al. | |
| 5,901,467 | A * | 5/1999 | Peterson | A43B 13/20 36/35 B |
| 5,930,918 | A | 8/1999 | Healy et al. | |
| 6,127,026 | A | 10/2000 | Bonk et al. | |
| 6,253,466 | B1 | 7/2001 | Harmon-Weiss et al. | |
| 6,846,534 | B2 | 1/2005 | Bonk et al. | |
| 6,946,050 | B2 | 9/2005 | Dojan et al. | |
| 7,086,179 | B2 * | 8/2006 | Dojan | A43B 21/28 36/28 |
| 7,290,357 | B2 * | 11/2007 | McDonald | A43B 3/0057 36/102 |
| 7,451,557 | B2 * | 11/2008 | McDonald | A43B 3/246 36/105 |
| 7,647,709 | B2 * | 1/2010 | Reilly | A43B 23/17 36/107 |
| 8,241,450 | B2 | 8/2012 | Hensley et al. | |
| 8,291,618 | B2 | 10/2012 | Ellis | |
| 2002/0053146 | A1 | 5/2002 | Swigart | |
| 2004/0025375 | A1 * | 2/2004 | Turner | A43B 13/12 36/35 B |
| 2004/0237346 | A1 | 12/2004 | Rudy | |
| 2005/0132607 | A1 * | 6/2005 | Dojan | A43B 21/28 36/28 |
| 2005/0262739 | A1 * | 12/2005 | McDonald | A43B 13/16 36/102 |
| 2005/0268491 | A1 * | 12/2005 | McDonald | A43B 9/00 36/28 |
| 2006/0086003 | A1 * | 4/2006 | Tseng | A43B 21/28 36/35 B |
| 2007/0119075 | A1 * | 5/2007 | Schindler | B29C 49/48 36/35 B |
| 2007/0169376 | A1 * | 7/2007 | Hatfield | A43B 7/1415 36/35 B |
| 2007/0199211 | A1 * | 8/2007 | Campbell | A43C 15/162 36/102 |
| 2007/0240331 | A1 * | 10/2007 | Borel | A43B 13/026 36/28 |
| 2008/0083140 | A1 | 4/2008 | Ellis | |
| 2009/0090025 | A1 * | 4/2009 | Cassiday | A43B 21/28 36/35 B |
| 2009/0113757 | A1 * | 5/2009 | Banik | A43B 13/188 36/35 R |
| 2009/0151195 | A1 | 6/2009 | Forstrom et al. | |
| 2015/0223564 | A1 | 8/2015 | Peyton et al. | |
| 2015/0257483 | A1 * | 9/2015 | Meschter | A43B 21/28 36/29 |

OTHER PUBLICATIONS

Patent Cooperation Treaty, International Search Report and Written Opinion of the International Searching Authority for PCT/US2020/061020 mailed Apr. 16, 2021.

Patent Cooperation Treaty, Invitation to Pay Additional Fees, and, Where Applicable, Protest Fee, for Application No. PCT/US2020/061020 mailed Feb. 26, 2021.

USPTO, Final Office Action for U.S. Appl. No. 16/950,791, mailed Oct. 17, 2022.

USPTO, Non-Final Office Action for U.S. Appl. No. 16/950,791, mailed Jun. 10, 2022.

USPTO, Final Office Action for U.S. Appl. No. 16/950,791, mailed Mar. 22, 2022.

USPTO, Non-Final Office Action for U.S. Appl. No. 16/950,791, mailed Nov. 12, 2021.

Korean Intellectual Property Office, Office Action for KR App. No. 10-2023-7019694, mailed Feb. 14, 2024.

* cited by examiner

FIG. 9
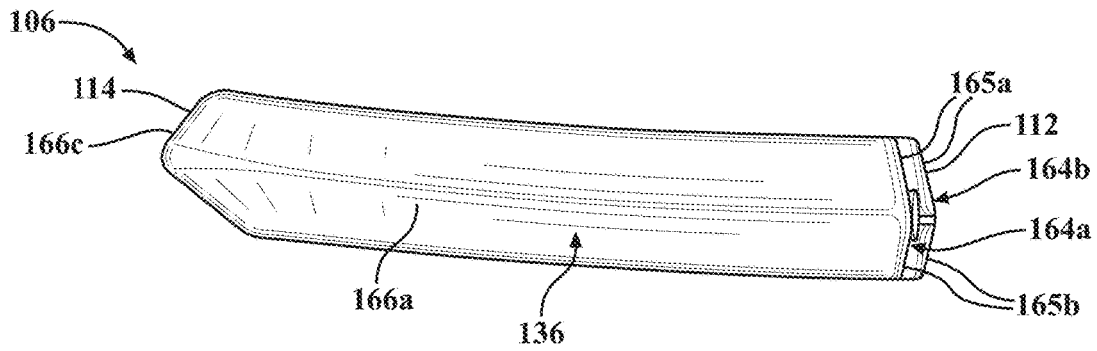
FIG. 10
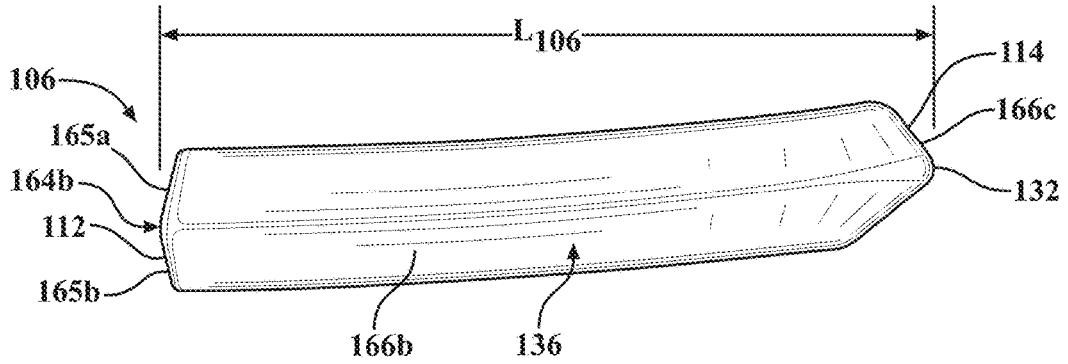
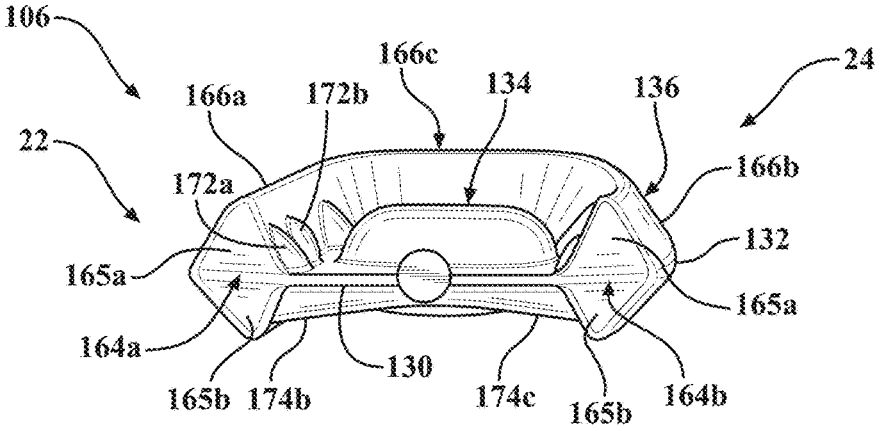
FIG. 11

SOLE STRUCTURE FOR ARTICLE OF FOOTWEAR

CROSS REFERENCE TO RELATED APPLICATION

This application is a continuation of U.S. application Ser. No. 16/950,791, filed Nov. 17, 2020, which claims priority to U.S. Provisional Application No. 62/937,531, filed Nov. 19, 2019, the contents of which are hereby incorporated by reference in their entirety.

FIELD

The present disclosure relates generally to sole structures for articles of footwear, and more particularly, to sole structures incorporating a bladder.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

FIG. 9 is a lateral side perspective view of the bladder of the article of footwear of FIG. 1, FIG. 10 is a medial side perspective view of the bladder of the article of footwear of FIG. 1;

FIG. 11 is a front perspective view of the bladder of the article of footwear of FIG. 1;

Corresponding reference numerals indicate corresponding parts throughout the drawings.

DETAILED DESCRIPTION

Figure 1:
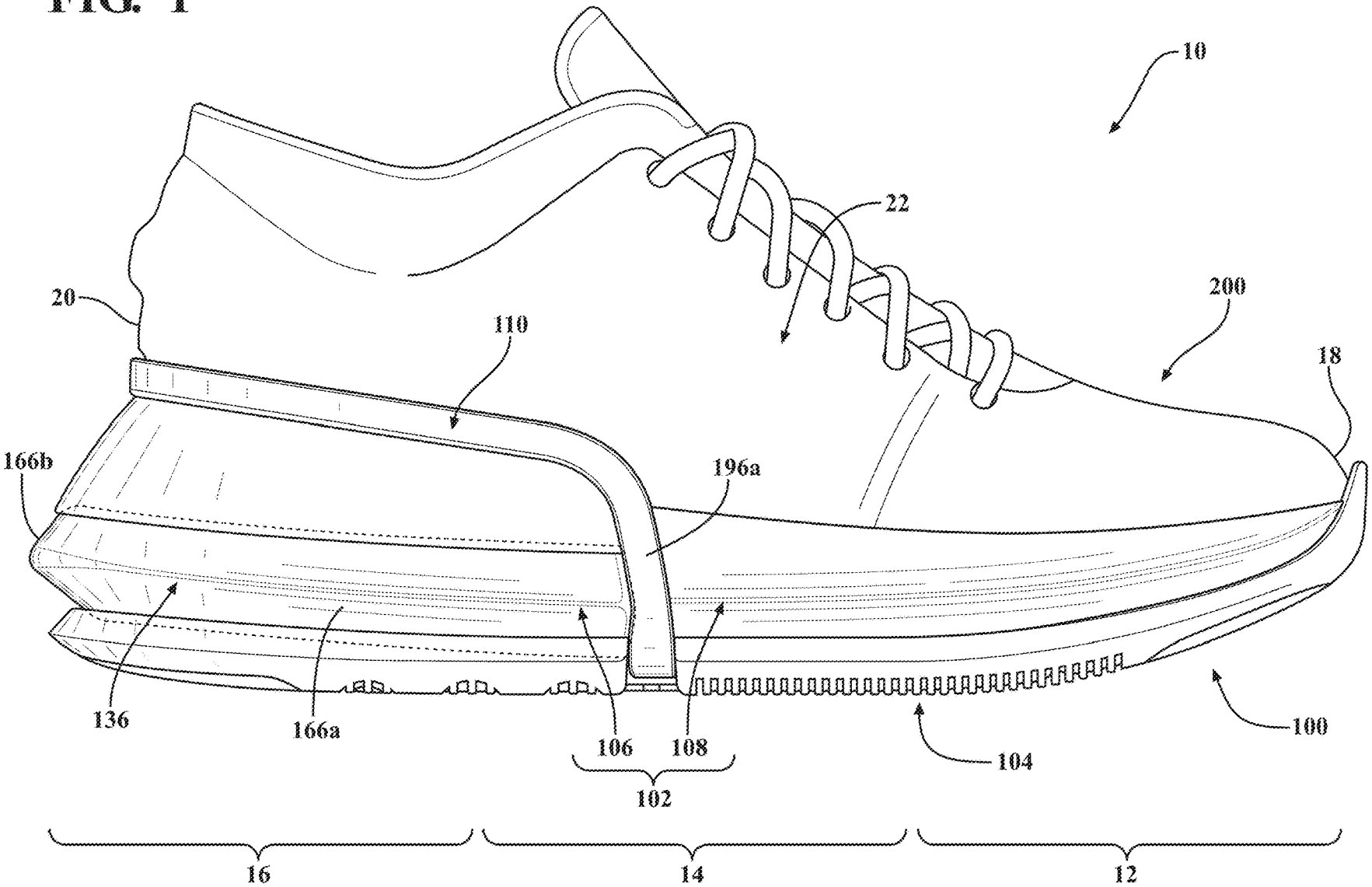
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In some aspects of the present disclosure, a bladder for an article of footwear is provided. The bladder includes a first chamber having a first segment extending along a first side of the bladder and a second segment formed on an opposite side of the bladder from the first segment. The bladder further includes a second chamber at least partially surrounded by the first chamber and disposed between the first segment and the second segment. A manifold is in direct fluid communication with each of the first segment of the first chamber, the second segment of the first chamber, and the second chamber. A web area connects each of the first chamber, the second chamber, and the manifold.

Implementations of the disclosure may include one or more of the following optional features.

In some implementations, the bladder further includes a first series of ports formed in the first segment of the first chamber and a second series of ports formed in the second segment of the first chamber. In some examples, each of the first series of ports and the second series of ports is rounded.

In some implementations, the bladder includes a first barrier layer and a second barrier layer joined together at discrete locations to define each of the first chamber, the second chamber, the manifold, and the web area. Optionally, the manifold is formed entirely within the second barrier layer. In some examples, a portion of the first barrier layer opposing the manifold may be planar.

In some configurations, the second chamber has an anterior end having a first width and a posterior end having a second width that is greater than the first width. In some examples, the second chamber is ellipsoidal.

In some implementations, the first chamber further includes a third segment connecting the first segment to the second segment at a posterior end of the bladder. Here, each of the first segment, the second segment, and the third segment may extend along a respective arcuate path around the second chamber.

In another aspect of the disclosure, a bladder for an article of footwear is provided. The bladder includes a first chamber disposed in an interior portion of the bladder and extending from a first end to a second end, where a width of the first chamber tapers in a direction extending from the first end to the second end. The bladder further includes a second chamber at least partially surrounding the first chamber and having a polygonal cross-sectional shape.

Implementations of the disclosure may include one or more of the following optional features.

In some examples, the first chamber includes opposing, substantially parallel surfaces disposed between portions of the second chamber.

Optionally, the second chamber has plurality of sidewalls arranged in a quadrilateral shape. Here, the plurality of sidewalls may include a pair of upper sidewalls converging with each other to form an upper edge of the bladder and a pair of lower sidewalls converging with each other to form a lower edge of the bladder. In some examples, the plurality of sidewalls includes an inner-upper sidewall and an inner-lower sidewall converging with each other at a web area of the bladder. Here, at least one of the inner-upper sidewall or the inner-lower sidewall may include a series of rounded ports formed between the at least one of the inner-upper sidewall or the inner-lower sidewall and the web area.

In some examples, the second chamber extends from a first terminal end to a second terminal end, and each of the first terminal end and the second terminal end includes a planar upper face and a planar lower face.

In some configurations, the bladder further includes a manifold having a first conduit in fluid communication with the first chamber and a second conduit in fluid communication with the second chamber.

In some examples, the bladder further includes a web area separating the first chamber from the second chamber.

In another aspect of the disclosure, a sole structure including the bladder of any of the preceding paragraphs is provided. In some examples, the sole structure is incorporated in an article of footwear.

Figure 2:
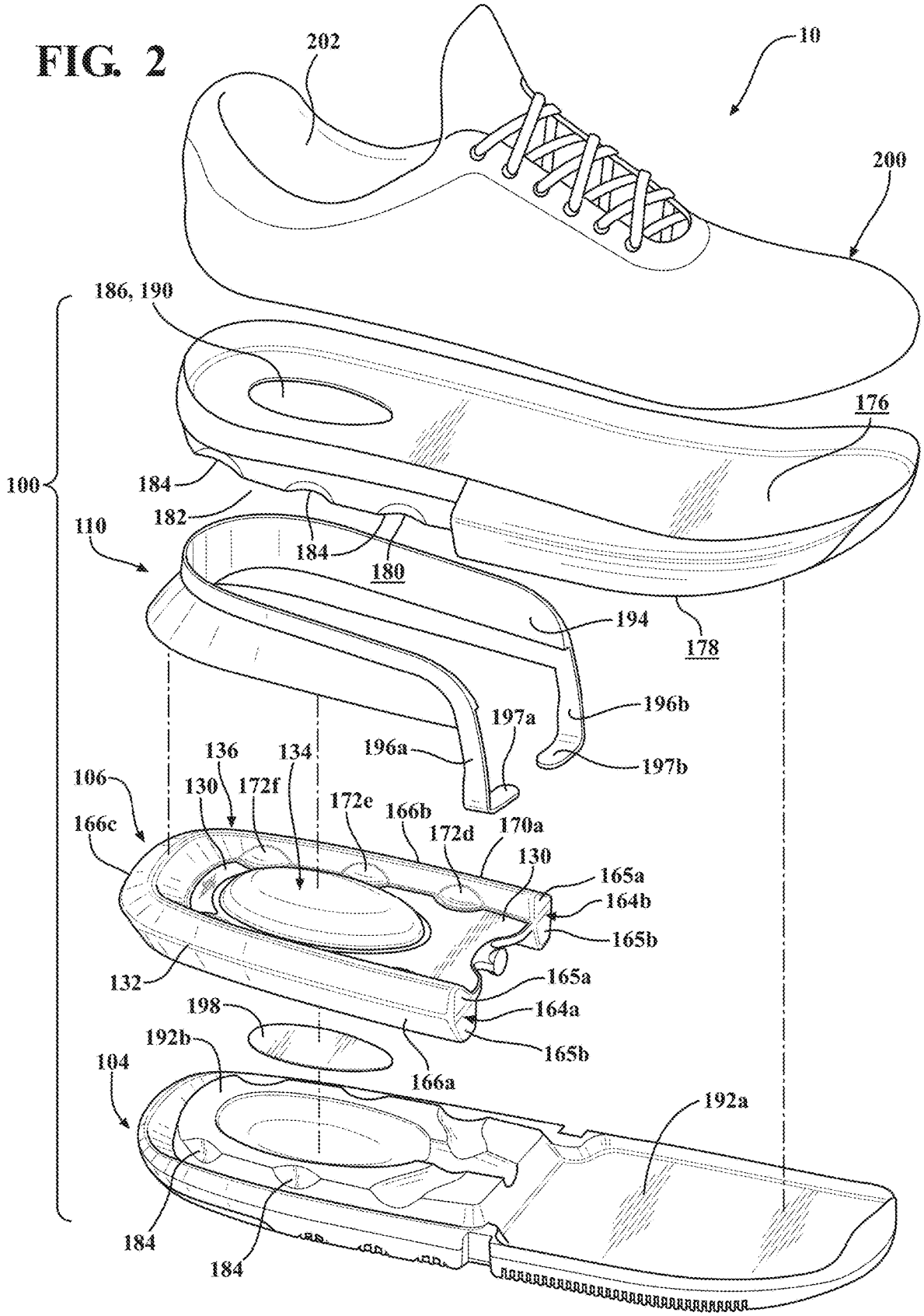
FIG. 2 is an exploded view of the article of footwear of FIG. 1, showing an article of footwear having an upper, a midsole, and an outsole arranged in a layered configuration.
Figure 3:
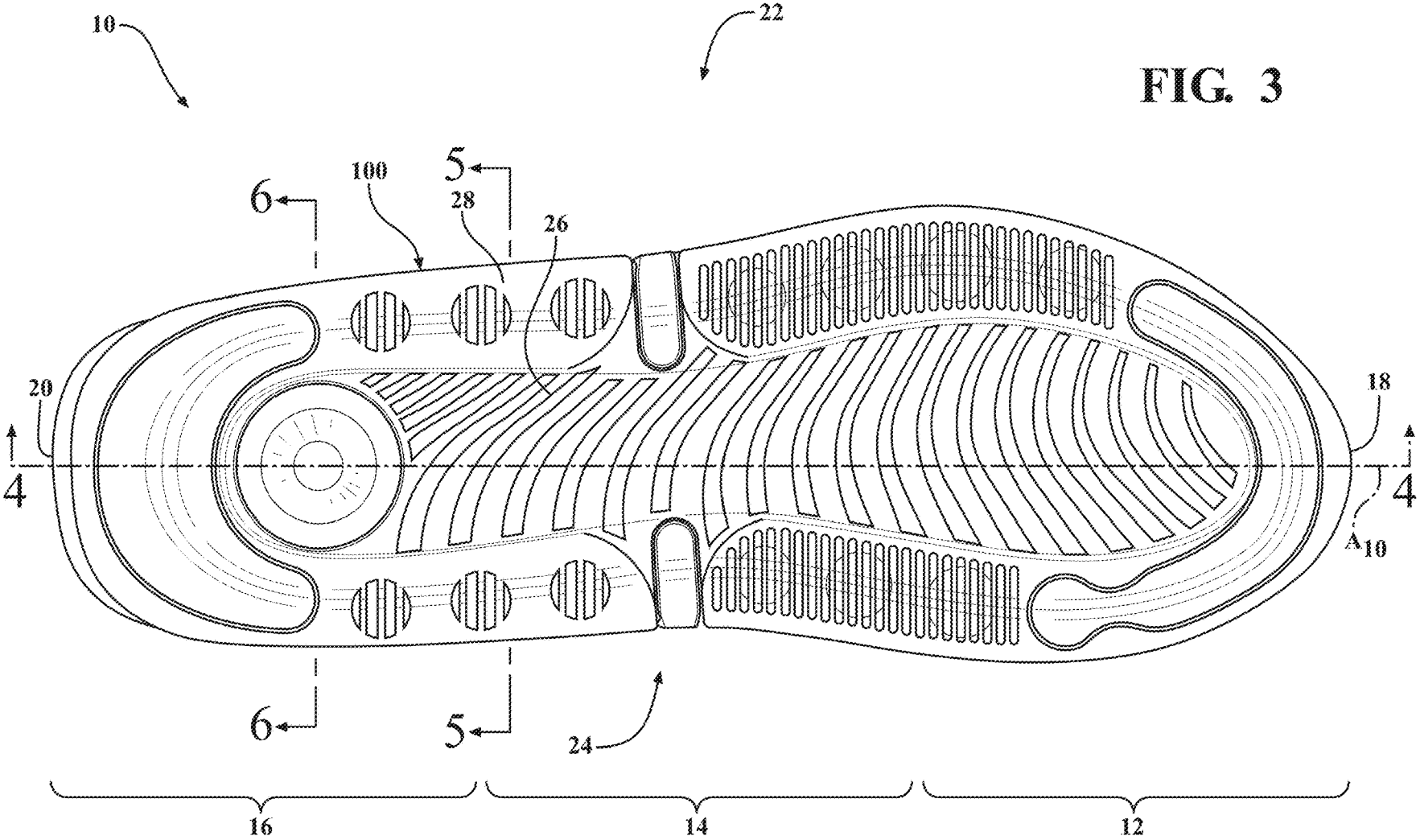
FIG. 3 is a bottom plan view of the article of footwear of FIG. 1.

Referring to FIGS. 1-6, an article of footwear 10 includes a sole structure 100 and an upper 200 attached to the sole structure 100. The article of footwear 10 may be divided into one or more regions. The regions may include a forefoot region 12, a mid-foot region 14, and a heel region 16. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a lateral side 22 and a medial side 24, as shown in FIG. 3. Accordingly, the lateral side 22 and the medial side 24 respectively correspond with opposite sides of the footwear 10 and extend through the regions 12, 14, 16.

The article of footwear 10, and more particularly, the sole structure 100, may be further described as including an interior region 26 and a peripheral region 28, as indicated in FIG. 3. The peripheral region 28 is generally described as being a region between the interior region 26 and an outer perimeter of the sole structure 100. Particularly, the peripheral region 28 extends from the forefoot region 12 to the heel region 16 along each of the lateral side 22 and the medial side 24, and wraps around each of the forefoot region 12 and the heel region 16. Thus, the interior region 26 is circumscribed by the peripheral region 28, and extends from the forefoot region 12 to the heel region 16 along a central portion of the sole structure 100.

With reference to FIG. 2, the sole structure 100 includes a midsole 102 configured to provide cushioning characteristics to the sole structure 100, and an outsole 104 configured to provide a ground-engaging surface 30 of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a bladder 106 and a chassis 108, where the chassis 108 is attached to the upper 200 and provides an interface between the upper 200, the bladder 106, and the outsole 104. The sole structure 100 may further include a heel counter 110 extending around the heel region 16 of the midsole 102 and the upper 200, as described in greater detail below.

Figure 7:
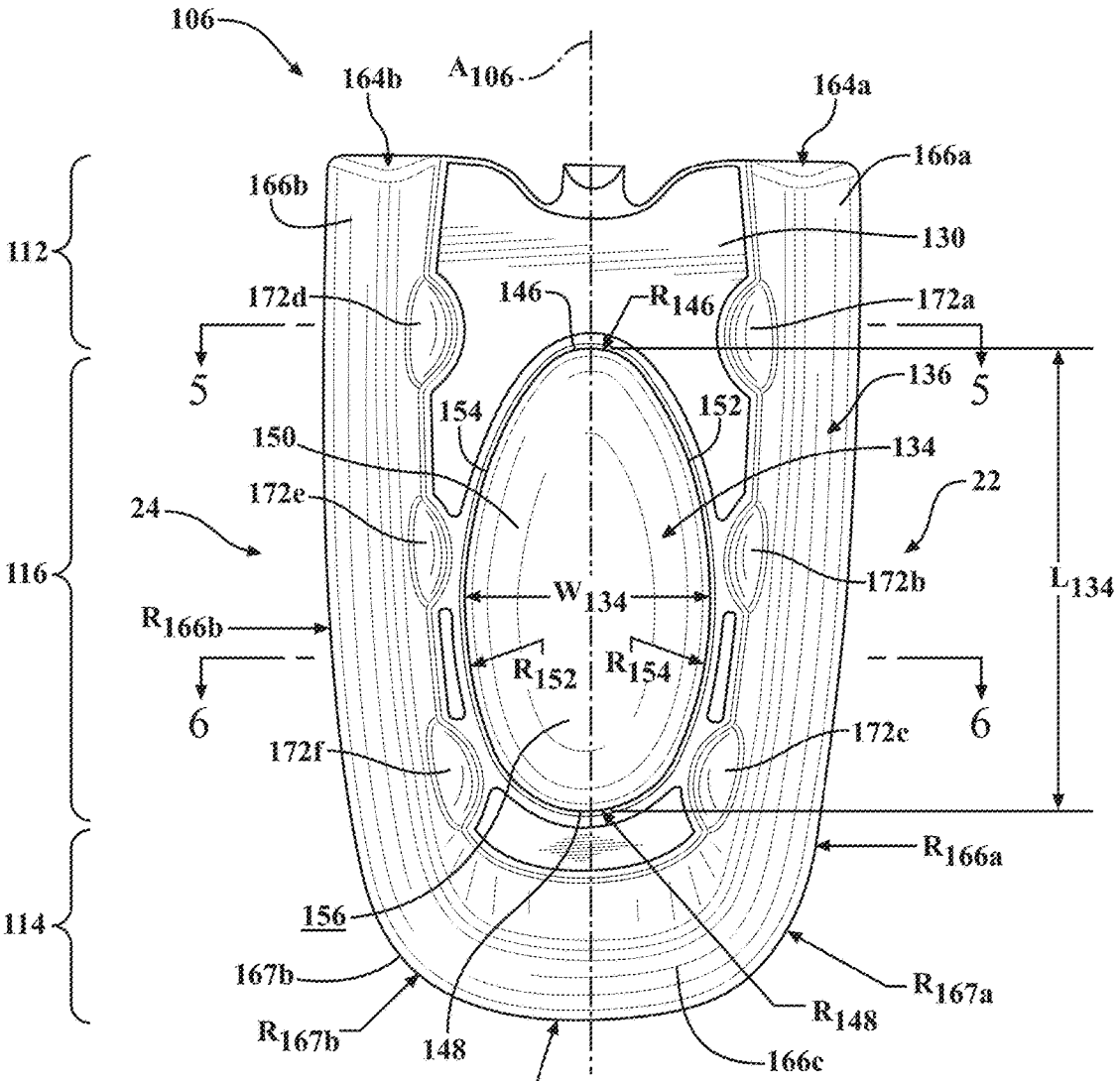
FIG. 7 is a top plan view of the bladder of the article of footwear of FIG. 1.
Figure 8:
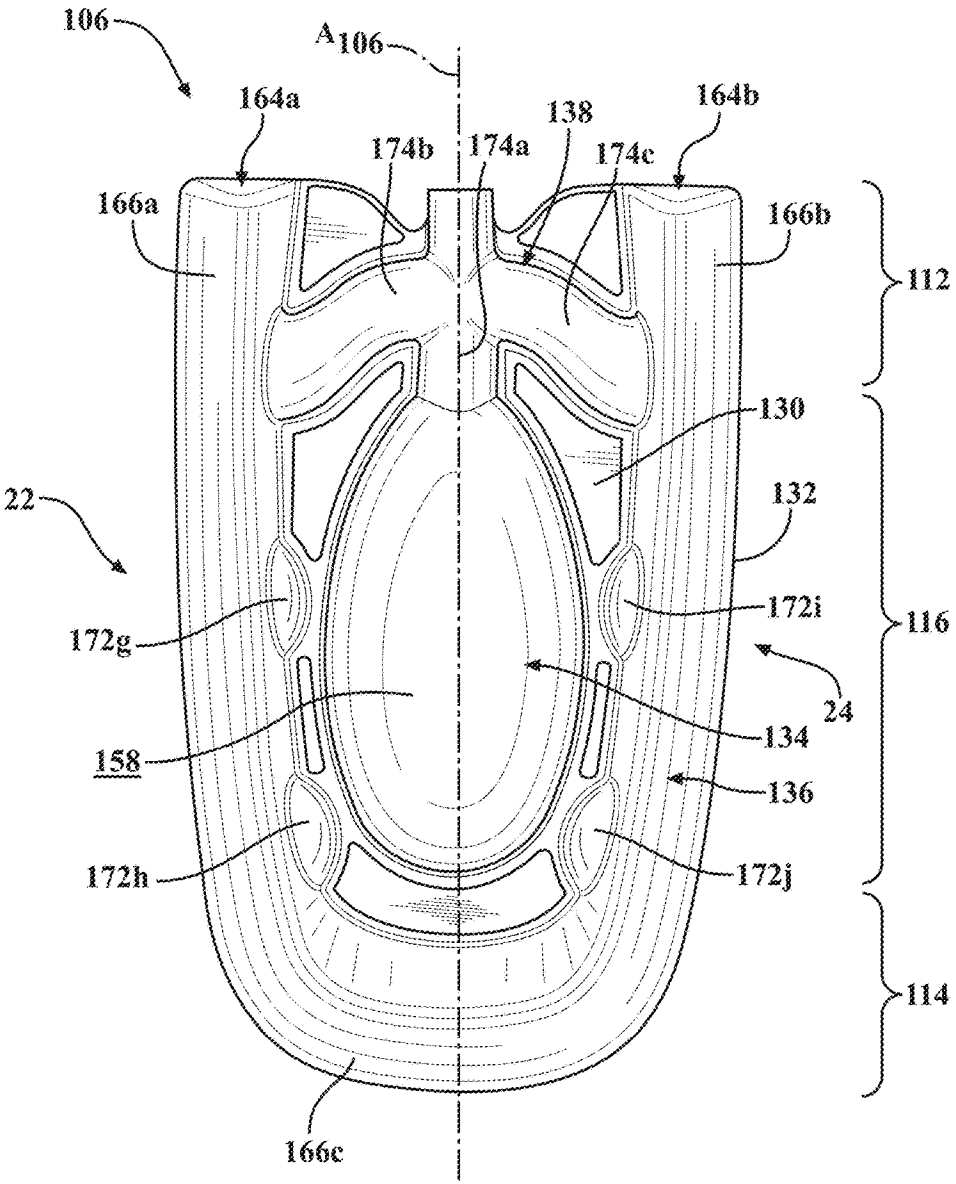
FIG. 8 is a bottom plan view of the bladder of the article of footwear of FIG. 1.
Figure 12:
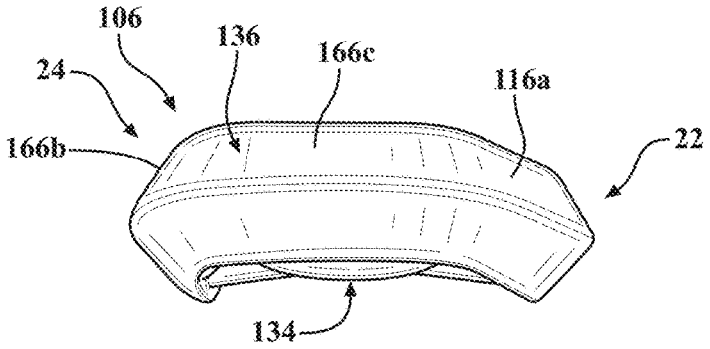
FIG. 12 is a rear perspective view of the bladder of the article of footwear of FIG. 1.
Figure 13:
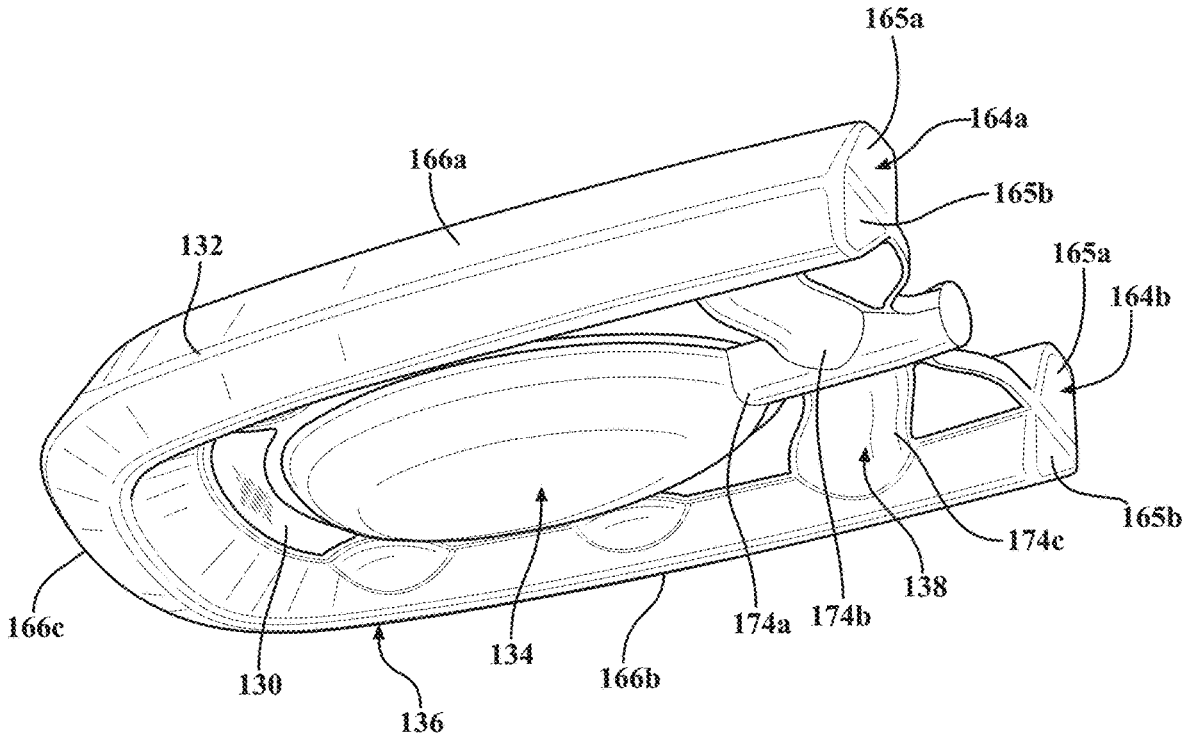
FIG. 13 is a front-bottom perspective view of the bladder of the article of footwear of FIG. 1.

With reference to FIGS. 7 and 8, the bladder 106 of the midsole 102 may be described as extending along a longitudinal axis $A_{106}$ from a first, anterior end 112 to a second, posterior end 114 disposed at an opposite end of the bladder 106 than the anterior end 112. When incorporated into the article of footwear 10, the anterior end 112 of the bladder 106 is disposed within the heel region 16 or the mid-foot region 14 and faces the anterior end 18 of the footwear 10, while the posterior end 114 is disposed at the posterior end 20 of the footwear 10. The bladder 106 may be further described as including an intermediate portion 116 disposed between the anterior end 112 and the posterior end 114. The geometry and features of the bladder 106 may also be described relative to the peripheral region 28 and the interior region 26 of the article of footwear 10.

Figure 4:
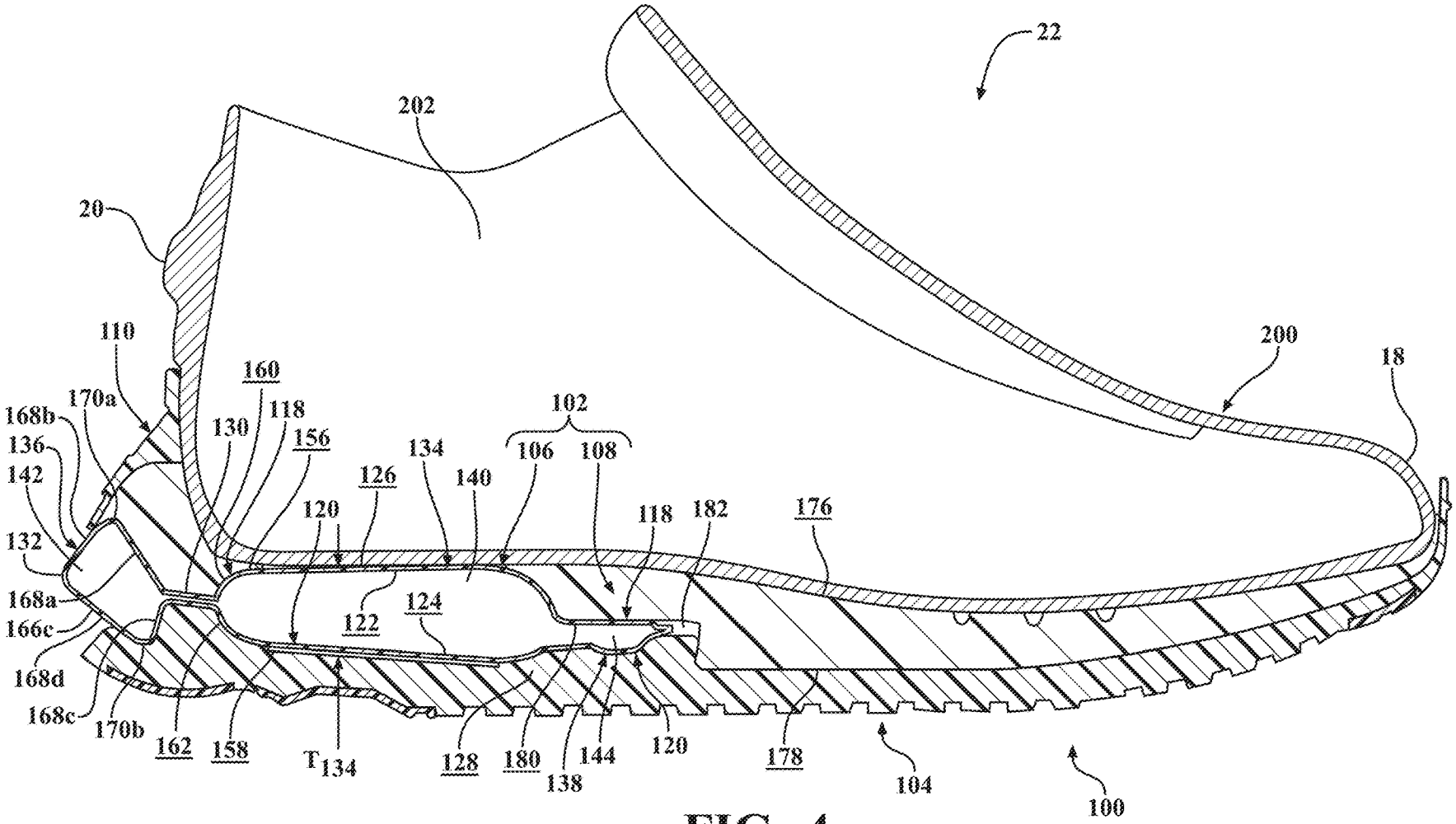
FIG. 4 is a cross-sectional view taken along line 4-4 of FIG. 3, showing a bladder disposed in a heel region and having a peripheral chamber and an interior chamber separated by a web area.
Figure 6:
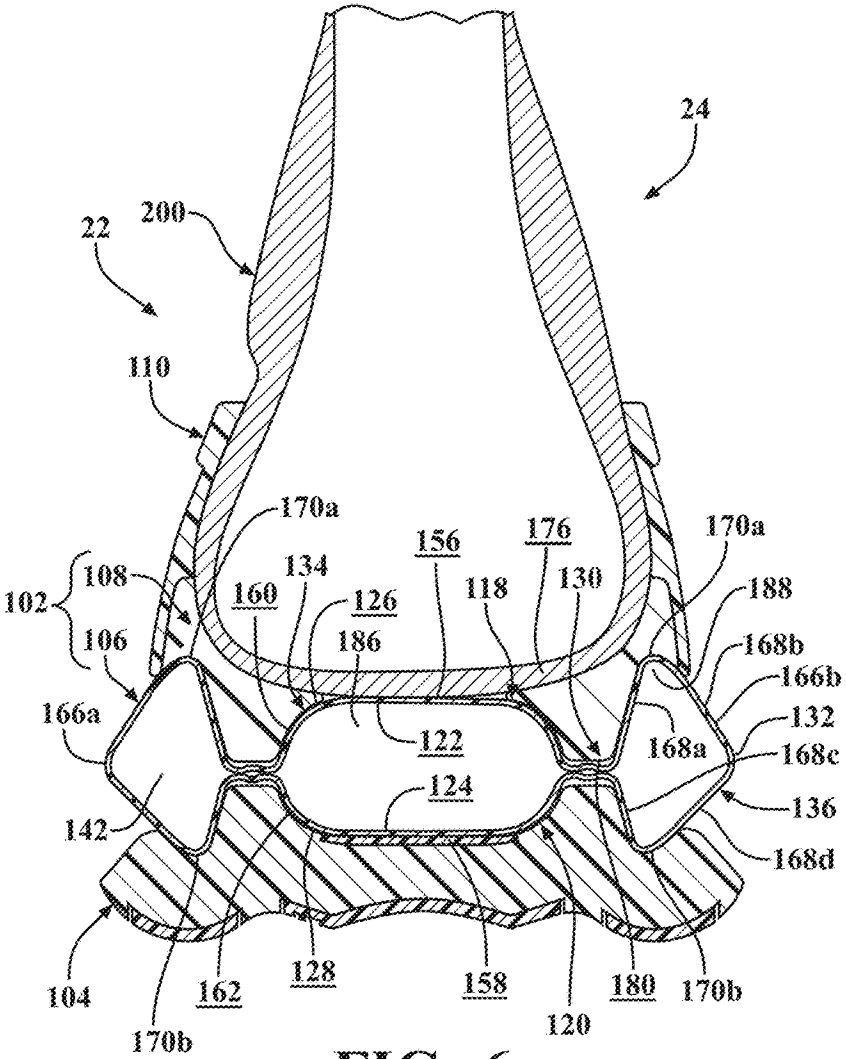
FIG. 6 is a cross-sectional view taken along line 6-6 of FIG. 3, showing a bladder having a peripheral chamber and an interior chamber separated by a web area.
Figure 5:
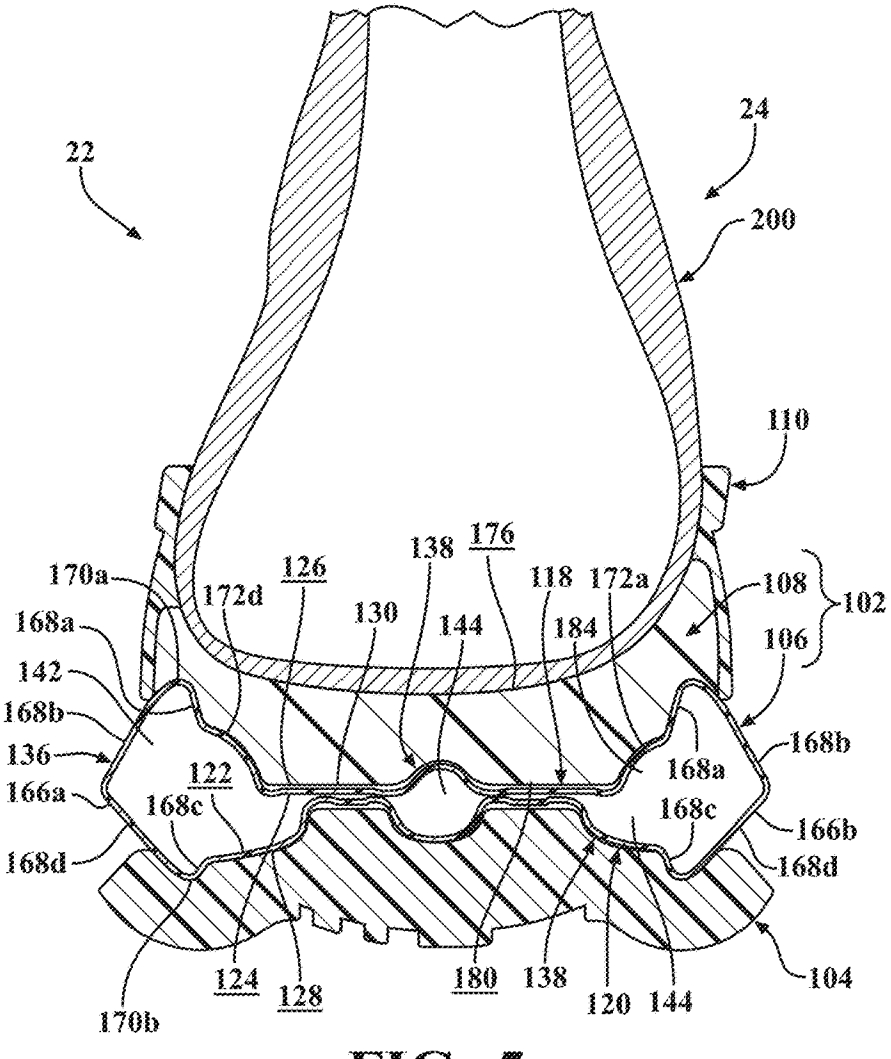
FIG. 5 is a cross-sectional view taken along line 5-5 of FIG. 3, showing segments of a peripheral chamber of a bladder disposed within a heel region of the sole structure and separated from one another by a web area.

As shown in the cross-sectional views of FIGS. 4-6, the bladder 106 may be formed by an opposing pair of barrier layers 118, 120, which can be joined to each other at discrete locations to define an overall shape of the bladder 106. Alternatively, the bladder 106 can be produced from any suitable combination of one or more barrier layers. As used herein, the term "barrier layer" (e.g., barrier layers 118, 120) encompasses both monolayer and multilayer films. In some embodiments, one or both of the barrier layers 118, 120 are each produced (e.g., thermoformed or blow molded) from a monolayer film (a single layer). In other embodiments, one or both of the barrier layers 118, 120 are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 118, 120 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 118, 120 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocyanurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocyanates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 118, 120 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 118, 120 include two or more sublayers, examples of suitable multilayer films include microlayer films, such as those disclosed in Bonk et al., U.S. Pat. No. 6,582,786, which is incorporated by reference in its entirety. In further embodiments, the barrier layers 118, 120 may each independently include alternating sublayers of one or more TPU copolymer materials and one or more EVOH copolymer materials, where the total number of sublayers in each of the barrier layers 118, 120 includes at least four (4) sublayers, at least ten (10) sublayers, at least twenty (20) sublayers, at least forty (40) sublayers, and/or at least sixty (60) sublayers.

The bladder 106 can be produced from the barrier layers 118, 120 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 118, 120 can be produced by co-extrusion followed by vacuum thermoforming to form the profile of the bladder 106, which can optionally include one or more valves 121 (e.g., one way valves) that allows the bladder 106 to be filled with the fluid (e.g., gas).

The bladder 106 desirably has a low gas transmission rate to preserve its retained gas pressure. In some embodiments, the bladder 106 has a gas transmission rate for nitrogen gas that is at least about ten (10) times lower than a nitrogen gas transmission rate for a butyl rubber layer of substantially the same dimensions. In an aspect, bladder 106 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 118, 120). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the shown embodiment, the barrier layers 118, 120 include a first, upper barrier layer 118 and a second, lower barrier layer 120. Each of the barrier layers 118, 120 includes an interior surface 122, 124 and a corresponding exterior surface 126, 128 formed on an opposite side of the barrier layer 118, 120 from the respective interior surface 122, 124. The exterior surface 126 of the upper barrier layer 118 defines an upper surface of the bladder 106 and the exterior surface 128 of the lower barrier layer 120 defines a lower surface of the bladder 106. As discussed below, thicknesses of the bladder 106 are defined by distances from the exterior surface 126 of the upper barrier layer 118 to the exterior surface 128 of the lower barrier layer 120, measured along a vertical direction (i.e., perpendicular to the ground surface).

In the illustrated example, the interior surfaces 122, 124 of the barrier layers 118, 120 are joined together at discrete locations to form a web area 130 and a peripheral seam 132. The peripheral seam 132 extends around the outer periphery of the peripheral chamber 136 and defines an outer peripheral profile of the bladder 106. As shown in FIGS. 4-6, the interior surfaces 122, 124 of the upper and lower barrier layers 118, 120 are spaced apart from each other between the web area 130 and the peripheral seam 132 to define a plurality of chambers 134, 136 and a manifold 138 each including a respective interior void 140, 142, 144.

As best shown in FIG. 2, the bladder 106 includes a first, interior chamber 134 disposed in the interior region 26 of the bladder 106 and a second, peripheral chamber 136 surrounding the interior chamber 134. The web area 130 surrounds the interior chamber 134 and separates the interior chamber 134 from the peripheral chamber 136 such that the interior voids 140, 142 of the interior chamber 134 and the peripheral chamber 136 are not in direct fluid communication with each other (i.e., fluid or media cannot transfer directly between the interior voids 140, 142), but are instead fluidly connected to each other via the interior void 144 of the manifold 138. When incorporated within the article of footwear 10, the interior chamber 134 is configured to support a central portion of the heel corresponding to the bottom of the calcaneus bone, while the peripheral chamber 136 provides a separate support structure that receives a portion of the heel therein.

As shown in FIGS. 7 and 8, the interior chamber 134 extends continuously along the longitudinal axis $A_{106}$ of the bladder from an anterior end 146 at the anterior end 112 of the bladder 106 to a posterior end 148 at the posterior end 114 of the bladder 106. A distance from the anterior end 146 to the posterior end 148 defines a length $L_{134}$ of the interior chamber 134. The interior chamber 134 may be described as including an intermediate portion 150 disposed between the anterior end 146 and the posterior end 148. The interior chamber 134 may be further defined by a lateral side 152 and a medial side 154 each extending along opposite sides of the interior chamber 134 from the anterior end 146 to the posterior end 148, whereby a width $W_{134}$ of the interior chamber 134 is defined by a lateral distance (i.e., perpendicular to the longitudinal axis $A_{106}$) from the lateral side 152 to the medial side 154.

Referring to FIGS. 7 and 8, the interior chamber 134 may be configured such that the width $W_{134}$ tapers along a lengthwise direction of the longitudinal axis $A_{106}$ of the bladder 106. As shown in FIGS. 7 and 8, an outer periphery of the interior chamber 134, which is collectively defined by the anterior end 146, the posterior end 148, the lateral side 152, and the medial side 154, is oval-shaped such that the width $W_{134}$ of the interior chamber 134 is greater at the intermediate portion 150 than at each of the anterior end 146 and the posterior end 148. In some examples, the outer periphery defines an egg shape, whereby the anterior end 146 has a first radius $R_{146}$, the posterior end 148 has a second radius $R_{148}$ that is greater than the first radius, and each of the sides 152, 154 has a third radius $R_{152}$, $R_{154}$ that is greater than each of the first radius $R_{146}$ and the second radius $R_{148}$. Accordingly, the interior chamber 134 may be embodied as an asymmetrical ellipsoid.

With reference to FIGS. 4 and 6, the interior chamber 134 may be further described as including a top surface 156 defined by the exterior surface 126 of the upper barrier layer 118 and a bottom surface 158 formed on an opposite side from the top surface 156 and defined by the exterior surface 128 of the lower barrier layer 120. Each of the top surface 156 and the bottom surface 158 may be substantially planar, and have a peripheral profile corresponding to the outer periphery of the interior chamber 134. For example, an outer periphery of the top surface 156 may be egg-shaped such that the top surface 156 has a narrower width at the anterior end 146 than at the posterior end 148.

Referring to FIG. 4, a distance between the top surface 156 and the bottom surface 158 defines a thickness $T_{134}$ of the interior chamber 134. As shown, the thickness $T_{134}$ of the interior chamber 134 may taper along the lengthwise direction of the bladder 106. For example, the top surface 156 and the bottom surface 158 converge with each other along a direction from the posterior end 148 to the anterior end 146 such that the thickness $T_{134}$ of the interior chamber 134 decreases. In the illustrated example, the interior chamber 134 tapers at a constant and continuous rate from the posterior end 148 to the anterior end 146.

The interior chamber 134 further includes an upper peripheral side surface 160 extending from the top surface 156 to the web area 130, and a lower peripheral side surface 162 extending from the bottom surface 158 to the web area 130. Each of the peripheral side surfaces 160, 162 is continuously curved or arcuate between the web area 130 and the respective top and bottom surfaces 156, 158, as shown in FIGS. 4 and 6. Accordingly, the peripheral side surfaces 160, 162 cooperate to provide the interior chamber 134 with a continuously curved side between the top surface 156 and the bottom surface 158.

With continued reference to FIGS. 7 and 8, the peripheral chamber 136 extends along the peripheral region 28 and partially surrounds the interior chamber 134. Particularly, the peripheral chamber 136 extends from a first terminal end 164*a* on the lateral side of the anterior end 112 and around the posterior end 148 of the interior chamber 134 to a second terminal end 164*b* on the medial side of the anterior end 112. As shown, each of the terminal ends 164*a*, 164*b* may be polygonal and include a substantially planar upper face 165*a* defined by the upper barrier layer 118 and a substantially planar lower face 165*b* defined by the lower barrier layer 120. The respective upper faces are formed at an oblique angle relative to the lower faces such that the respective upper and lower faces of the terminal ends 164*a*, 164*b* are both angled rearwardly from the peripheral seam 132.

The peripheral chamber 136 may be described as including a plurality of segments 166*a*-166*c*. Here, a lateral segment 166 extends from the first terminal end 164*a* to the posterior end 114 of the bladder 106 along the lateral side of the bladder 106, a medial segment 166*b* extends from the second terminal end 164*b* to the posterior end 114 along the medial side of the bladder 106, and a posterior segment 166*c* extends from the lateral segment 166*a* to the medial segment 166*b* along the posterior end 114 of the bladder 106.

While each of the segments 166*a*-166*b* is substantially elongate, the segments 166*a*-166*b* may each extend along a respective path having a concave curvature relative to the interior chamber 134. In other words, each of the segments 166*a*-166*c* has a slight curvature around the interior chamber 134. Furthermore, intersections 167*a*, 167*b* between the posterior segment 166*c* and each of the lateral segment 166*a* and the medial segment 166*b* may also be curved, and have a radius $R_{167a}$, $R_{167b}$ that is substantially smaller than the respective radii $R_{166a}$-$R_{166c}$ of the segments 166*a*-166*c*, such that the intersections 167*a*, 167*b* provide the peripheral chamber 136 with curved corners at the posterior end 114 of the bladder 106.

Referring now to FIGS. 4-6, the peripheral chamber 136 is defined by a plurality of sidewalls 168*a*-168*d* arranged to provide the peripheral chamber 136 with a polygonal cross-sectional shape. In the illustrated example, the peripheral chamber 136 includes a plurality of substantially straight sidewalls 168*a*-168*d* arranged in a quadrilateral shape. Here, the sidewalls 168*a*-168*d* are arranged in a diamond-like shape, having a pair of upper sidewalls 168*a*, 168*b* formed by the upper barrier layer 118 and a pair of lower sidewalls 168*c*, 168*d* formed by the lower barrier layer 120. As described below, the respective pairs of the upper sidewalls 168*a*, 168*b* and the lower sidewalls 168*c*, 168*d* converge with each other at upper and lower edges 170*a*, 170*c* formed on opposite sides (e.g., top and bottom) of the bladder 106. Each of the upper edge 170*a* and the lower edge 170*b* may be radiused.

With continued reference to FIGS. 4-6, the pair of upper sidewalls 168*a*, 168*b* includes an inner-upper sidewall 168*a* and an opposing outer-upper sidewall 168*b* that converge with each other at the upper edge 170*a*. The inner-upper sidewall 168*a* extends from the web area 130 at a first oblique angle relative to the web area 130. As shown, the inner-upper sidewall 168*a* extends upwardly and outwardly from the web area 130 to the upper edge 170*a*. The outer-upper sidewall 168*b* extends from the peripheral seam 132 at a second oblique angle relative to the web area 130. As shown, the outer-upper sidewall 168*b* extends inwardly and upwardly from the peripheral seam 132 to the upper edge 170*a*.

On the bottom of the bladder 106, the inner-lower sidewall 168*c* extends from the web area 130 at a third oblique angle relative to the web area 130. Particularly, the inner-lower sidewall 168*c* extends downwardly and outwardly from the web area 130 to the lower edge 170*b*. Conversely, the outer-lower sidewall 168*d* extends at a fourth oblique angle from the peripheral seam 132 to the lower edge 170*b*, such that the outer-lower sidewall 168*d* extends downwardly and inwardly from the peripheral seam 132 to the lower edge 170.

With continued reference to FIGS. 7 and 8, the inner sidewalls 168*a*, 168*c* of the peripheral chamber 136 may each include one or more ports 172*a*-172*j* formed therein. As shown, each of the ports 172*a*-172*j* is formed as a rounded protrusion from each of the inner sidewalls 168*a*, 168*c*. Particularly, each of the ports 172*a*-172*j* is a semi-spherical protrusion formed between the web area 130 and the respective inner sidewall 168*a*, 168*c*. As such, an interior of each of the ports 172*a*-172*j* defines a semi-spherical void (FIG. 5) in communication with the interior void 142 of the peripheral chamber 136. Accordingly, the ports 172*a*-172*j* are configured both as gussets between the inner sidewalls 168*a*, 168*c* and the web area 130 to provide the peripheral chamber 136 with improved lateral (i.e., side-to-side) stability, and to act as fluid expansion zones for damping pressure increases within the interior void 142 when the bladder 106 is compressed under the load of a foot. In the illustrated example, the inner sidewalls 168*a*, 168*c* each include a series of the ports 172*a*-172*j* formed along the lateral and medial segments 166*a*, 166*b*.

Referring to FIG. 7, the inner-upper sidewall 168*a* includes a first series of ports 172*a*-172*c* distributed along the lateral segment 166*a* and a second series of ports 172*d*-172*f* distributed along the medial segment 166*b*. Here, the first series of ports 172*a*-172*c* and the second series of ports 172*d*-172*f* each includes an anterior port 172*a*, 172*d* disposed adjacent to the anterior end 112, a posterior port 172*c*, 172*f* disposed adjacent to the posterior end 114, and one or more intermediate ports 172*b*, 172*e* disposed in the intermediate portion 116. The ports 172*a*-172*f* of each of the first series and the second series are evenly spaced from each other along each of the lateral and medial segments 166*a*, 166*b*.

Referring to FIG. 8, the inner-lower sidewall 168*c* includes a third series of ports 172*g*-172*h* distributed along the lateral segment 166*a* and a fourth series of ports 172*h*-172*i* distributed along the medial segment 166*b*. Here, the third series of ports 172*g*-172*h* and the fourth series of ports 172*i*-172*j* each includes a posterior port 172*h*, 172*j* disposed adjacent to the posterior end 114, and one or more intermediate ports 172*g*, 172*i* disposed in the intermediate portion 116. The ports 172*g*-172*j* of each of the first series and the second series are evenly spaced from each other along each of the lateral and medial segments 166*a*, 166*b*. Particularly, the intermediate and posterior ports 172*g*-172*j* of the inner-lower sidewall 168*c* are aligned with the intermediate and posterior ports 172*b*, 172*c*, 172*e*, 172*f* of the inner-upper sidewall 168*a* across the thickness of the bladder 106. Accordingly, the corresponding semi-spherical ports of the upper and lower inner sidewalls 168*a*, 168*c* cooperate with each other to form hemispherical structures between the peripheral chamber 136 and the web area 130.

Unlike the inner-upper sidewall 168*a*, the lower inner sidewall 168*c* does not include anterior ports. Instead, the manifold 138 is formed within the lower barrier layer 120 and provides fluid communication to the interior void 142 of the peripheral chamber 136 through the inner-lower sidewall 168*c* at locations aligned with the anterior ports 172*a*, 172*d* of the upper barrier layer 118. In the illustrated example, the upper barrier layer 118 and the lower barrier layer 120 cooperate to enclose the interior void 144 of the manifold 138. However, the geometry of the manifold 138 is formed entirely within the lower barrier layer 120 such that the upper barrier layer 118 merely acts as a cover for the interior void 144, as shown in FIGS. 4 and 5. Accordingly, the portion of the upper barrier layer 118 enclosing the interior void 144 is planar and provides a uniform surface that is flush with the web area 130 on top of the bladder 106.

With reference to FIG. 8, the manifold 138 includes a plurality of conduits 174*a*-174*c* each in fluid communication with the chambers 134, 136. As shown, the manifold 138 includes a first conduit 174*a* in fluid communication with the interior void 140 of the interior chamber 134 and a pair of laterally-extending conduits 174*b*, 174*c* extending from the first conduit 174*a* to each of the lateral segment 166*a* and the medial segment 166*b*. Each of the conduits 174*b*, 174*c* extends along a compound curve, whereby a first portion of the conduit 174*b*, 174*c* adjacent to the longitudinal axis $A_{106}$ of the bladder 106 has a concave curvature relative to the interior chamber 134 and a second portion of the conduit 174*b*, 174*c* that is connected to the peripheral chamber 136 has a convex curvature relative to the interior chamber 134. Particularly, the first portion of each conduit 174*b*, 174*c* extends around the interior chamber 134 while the second portion curves away from the interior chamber 134. As shown, this compound curvature results in each conduit 174*b*, 174*c* intersecting or connecting with the peripheral chamber 136 at a substantially perpendicular orientation relative to the inner-upper sidewall 168*a*.

The chambers 134, 136 can be provided in a fluid-filled (e.g., as provided in footwear 10) or in an unfilled state. The chambers 134, 136 can be filled to include any suitable fluid, such as a gas or liquid. In one aspect, the gas can include air, nitrogen ($N_2$), or any other suitable gas. The fluid provided to the chambers 134, 136 can result in the bladder 106 being pressurized. Alternatively, the fluid provided to the chambers 134, 136 can be at atmospheric pressure such that the chambers 134, 136 are not pressurized but, rather, simply contain a volume of fluid at atmospheric pressure. In other aspects, the chambers 134, 136 can alternatively include other compressible media, such as pellets, beads, ground recycled material, and the like (e.g., foamed beads and/or rubber beads).

In the illustrated example, the interior voids 140, 142, 144 of the bladder 106 include a first fluid at a first pressure. As discussed above, the interior chamber 134 is in fluid communication with the peripheral chamber 136 via the manifold 138 such that both chambers 134, 136 have the same pressure. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi.

With continued reference to FIGS. 1-4, the chassis 108 of the sole structure 100 extends continuously from the anterior end 18 to the posterior end 20. The chassis 108 includes a top surface 176 defining a profile of a footbed of the article of footwear 10. The chassis 108 further includes a bottom surface 178 and a recessed surface 180 formed on an opposite side of the chassis 108 than the top surface 176. In the illustrated example, the bottom surface 178 extends from the anterior end 18 of the sole structure 100 and terminates at an intermediate portion of the chassis 108 in the mid-foot region 14.

The recessed surface 180 is spaced between the top surface 176 and the bottom surface 178 and is configured to interface with the upper barrier layer 118 of the bladder 106. Thus, a depth or height of the recess 182 is defined by the offset distance between the bottom surface 178 and the recessed surface 180. As shown in FIGS. 4-6, the recessed surface 180 is configured to interface or mate with the exterior surface 126 of the upper barrier layer 118 such that the chassis 108 contacts the web area 130 and fills the space formed between the interior chamber 134 and the peripheral chamber 136. Accordingly, the recessed surface 180 may include features corresponding to the elements of the bladder 106 formed by the upper barrier layer 118. For example, the recessed surface 180 may include a series of dimples 184 configured to receive respective ones of the ports 172*a*-172*f*, a receptacle 186 configured to receive the interior chamber 134, and a channel 188 configured to receive the upper edge 170*a* of the bladder 106.

As shown in FIGS. 4 and 6, the receptacle 186 formed in the recessed surface 180 corresponds in shape to the shape of the interior chamber 134, such that the receptacle 186 conforms to the outer profile of the interior chamber 134. In some examples, the receptacle 186 is formed through a thickness of the chassis 108 from the recessed surface 180 to the top surface 176 and forms an opening 190 through the top surface 176. Here, the top surface 156 of the interior chamber 134 is exposed through the opening 190 such that the footbed of the upper 200 is in direct contact with the interior chamber 134.

With continued reference to FIG. 2, the outsole 104 of the sole structure is configured to receive each of the lower surface 178 of the chassis 108 and the lower portion of the bladder 106 formed by the lower barrier layer 120. As shown, the outsole 104 includes a first portion 192*a* formed in the forefoot region 12 and the mid-foot region 14 for receiving the lower surface 178 of the chassis 108, and a second portion 192*b* formed in the mid-foot region 14 and the heel region 16 for interfacing with the bladder 106. With reference to FIGS. 4-6, the second portion 192*b* of the outsole 104 includes features (e.g., dimples 184) configured to mate with the portions of the chambers 134, 136, the manifold 138, and the ports 172*g*-172*i* formed by the lower barrier layer 120. Accordingly, the second portion 192*b* of the outsole 104 substantially fills the space formed between the interior chamber 134 and the peripheral chamber 136.

Each of the outsole 104 and the chassis 108 may be formed of a resilient polymeric material, such as foam or rubber, to impart properties of cushioning, responsiveness, and energy distribution to the foot of the wearer. In some examples, the outsole 104 is formed of a first foam material and the chassis 108 is formed of a second foam material. For example, the chassis 108 may be formed of foam materials providing greater cushioning and impact distribution, while the outsole 104 is formed of a foam material having a greater stiffness and/or abrasion resistance to provide durability and stability to the sole structure.

Example resilient polymeric materials may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for the barrier layers 118, 120. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Optionally, the sole structure 100 may include additional components. For example, the sole structure 100 may include the heel counter 110 connecting the bladder 106, the outsole 104, and the chassis 108 in the heel region 16. The heel counter 110 includes a peripheral wall 194 configured to extend along the chassis 108 and the bladder 106 in the heel region 16, and a pair of fingers 196*a*, 196*b* extending from anterior ends of the peripheral wall 194 on the lateral side 22 and the medial side 24 of the sole structure 100 in the mid-foot region 14. Particularly, each of the fingers 196*a*, 196*b* extends to a respective distal end 197*a*, 197*b* beneath the outsole 104, such that the outsole 104 is captured between the distal ends 197*a*, 197*b* of the fingers 196*a*, 196*b* and the bottom surface 178 of the chassis 108.

With continued reference to FIG. 2, the sole structure 100 may further include a support plate 198 configured to be received between the bladder 106 and the outsole 104. Particularly, the support plate 198 may be disposed between the bottom surface 158 of the interior chamber 134 and the second portion 192*b* of the outsole 104 and may include an oval shape that mimics a shape of the interior chamber 134. The support plate 198 provides additional strength to the sole structure 100 in an area where the outsole 104 may be relatively thin due to the presence of the interior chamber 134.

The upper 200 is attached to the sole structure 100 and includes interior surfaces that define an interior void 202 configured to receive and secure a foot for support on sole structure 100. The upper 200 may be formed from one or more materials that are stitched or adhesively bonded together to form the interior void 202. Suitable materials of the upper may include, but are not limited to, mesh, textiles, foam, leather, and synthetic leather. The materials may be selected and located to impart properties of durability, air-permeability, wear-resistance, flexibility, and comfort.

The following Clauses provide an exemplary configuration for a bladder, a sole structure for an article of footwear, and/or an article of footwear described above.

Clause 1: A bladder for an article of footwear, the bladder including a first chamber having a first segment extending along a first side of the bladder and a second segment formed on an opposite side of the bladder from the first segment, a second chamber at least partially surrounded by the first chamber and disposed between the first segment and the second segment, a manifold in direct fluid communication with each of the first segment of the first chamber, the second segment of the first chamber, and the second chamber, and a web area connecting each of the first chamber, the second chamber, and the manifold.

Clause 2: The bladder of Clause 1, further comprising a first series of ports formed in the first segment of the first chamber and a second series of ports formed in the second segment of the first chamber.

Clause 3: The bladder of Clause 1 or 2, wherein each of the first series of ports and the second series of ports is rounded.

Clause 4: The bladder of any one of the preceding clauses, wherein the bladder includes a first barrier layer and a second barrier layer joined together at discrete locations to define each of the first chamber, the second chamber, the manifold, and the web area.

Clause 5: The bladder of Clause 4, wherein the manifold is formed entirely within the second barrier layer.

Clause 6: The bladder of Clause 4, wherein a portion of the first barrier layer opposing the manifold is planar.

Clause 7: The bladder of any one of the preceding clauses, wherein the second chamber has an anterior end having a first width and a posterior end having a second width that is greater than the first width.

Clause 8: The bladder of any one of the preceding clauses, wherein the second chamber is ellipsoidal.

Clause 9: The bladder of any one of the preceding clauses, wherein the first chamber further includes a third segment connecting the first segment to the second segment at a posterior end of the bladder.

Clause 10: The bladder of Clause 9, wherein each of the first segment, the second segment, and the third segment extends along a respective arcuate path around the second chamber.

Clause 11: A bladder for an article of footwear, the bladder comprising, a first chamber disposed in an interior portion of the bladder and extending from a first end to a second end, a width of the first chamber tapering in a direction extending from the first end to the second end, and a second chamber at least partially surrounding the first chamber and having a polygonal cross-sectional shape.

Clause 12: The bladder of Clause 11, wherein the first chamber includes opposing, substantially parallel surfaces disposed between portions of the second chamber.

Clause 13: The bladder of Clause 11 or 12, wherein the second chamber has plurality of sidewalls arranged in a quadrilateral shape.

Clause 14: The bladder of Clause 13, wherein the plurality of sidewalls includes a pair of upper sidewalls converging with each other to form an upper edge of the bladder and a pair of lower sidewalls converging with each other to form a lower edge of the bladder.

Clause 15: The bladder of any one of Clauses 13 or 14, wherein the plurality of sidewalls includes an inner-upper sidewall and an inner-lower sidewall converging with each other at a web area of the bladder.

Clause 16: The bladder of Clause 15, wherein at least one of the inner-upper sidewall or the inner-lower sidewall includes a series of rounded ports formed between the at least one of the inner-upper sidewall or the inner-lower sidewall and the web area.

Clause 17: The bladder of any one of Clauses 11-16, wherein the second chamber extends from a first terminal end to a second terminal end, each of the first terminal end and the second terminal end including a planar upper face and a planar lower face.

Clause 18: The bladder of any one of Clauses 11-17, further comprising a manifold having a first conduit in fluid communication with the first chamber and a second conduit in fluid communication with the second chamber.

Clause 19: The bladder of Clause 18, further comprising a web area separating the first chamber from the second chamber.

Clause 20: A sole structure for an article footwear, the sole structure including the bladder of any of the preceding clauses.

Clause 21: An article of footwear including the sole structure of Clause 20.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a midsole;

a fluid-filled chamber in contact with the midsole;

an outsole defining a ground-engaging surface of the sole structure; and a heel counter including a peripheral wall and at least one finger extending from an anterior end of the peripheral wall, the peripheral wall extending around a posterior end of the sole structure and having a bottom edge in contact with a first side of the fluid-filled chamber adjacent to the midsole, the at least one finger extending to a distal end beneath and in contact with the outsole.

2. The sole structure of claim 1, wherein the peripheral wall includes a first segment extending along a medial side of the sole structure, a second segment extending along a lateral side of the sole structure, and a third segment extending along a heel region of the sole structure and connecting the first segment and the second segment.

3. The sole structure of claim 1, wherein the at least one finger extends along an outer surface of the sole structure.

4. The sole structure of claim 1, wherein the at least one finger forms an external surface of the sole structure.

5. The sole structure of claim 2, wherein the at least one finger extends from the first segment of the peripheral wall or the second segment of the peripheral wall in a direction toward the ground-engaging surface.

6. The sole structure of claim 2, wherein the first segment, the second segment, and the third segment are in contact with the midsole and the fluid-filled chamber.

7. The sole structure of claim 2, wherein the first segment, the second segment, and the third segment cooperate to define a pocket that receives the midsole and the fluid-filled chamber.

8. The sole structure of claim 1, wherein the outsole is disposed between the at least one finger and the midsole.

9. An article of footwear incorporating the sole structure of claim 1.

10. A sole structure for an article of footwear, the sole structure comprising:

a midsole;

a fluid-filled chamber in contact with the midsole;

an outsole defining a ground-engaging surface of the sole structure; and a heel counter extending around a posterior end of the sole structure and including a peripheral wall extending between the midsole and the fluid-filled chamber and having a bottom edge in contact with the fluid-filled chamber and at least one finger extending from an anterior end of the peripheral wall to a distal end at the ground-engaging surface of the sole structure, the distal end disposed beneath the outsole.

11. The sole structure of claim 10, wherein the peripheral wall includes a first segment extending along a medial side of the sole structure, a second segment extending along a lateral side of the sole structure, and a third segment extending along a heel region of the sole structure and connecting the first segment and the second segment.

12. The sole structure of claim 11, wherein the at least one finger includes a first finger extending from the peripheral wall at the medial side and a second finger extending from the peripheral wall at the lateral side.

13. The sole structure of claim 10, wherein the at least one finger extends along an outer surface of the sole structure.

14. The sole structure of claim 10, wherein the at least one finger forms an external surface of the sole structure.

15. The sole structure of claim 10, wherein the distal end of the at least one finger extends along a surface of the outsole and forms a portion of the ground-engaging surface.

16. The sole structure of claim 11, wherein the first segment, the second segment, and the third segment are in contact with the midsole and the fluid-filled chamber.

17. The sole structure of claim 11, wherein the first segment, the second segment, and the third segment cooperate to define a pocket that receives the midsole and the fluid-filled chamber.

18. The sole structure of claim 10, wherein the outsole is disposed between the distal end of the at least one finger and the midsole.

19. An article of footwear incorporating the sole structure of claim 10.

* * * * *